US012612781B2

(12) United States Patent
Fox

(10) Patent No.: US 12,612,781 B2
(45) Date of Patent: Apr. 28, 2026

(54) ELEVATED KNIFE PLATE BRACKET

(71) Applicant: Fox Hardwood Lumber Company, L.L.C., Franklin, TN (US)

(72) Inventor: Samuel Fox, Franklin, TN (US)

(73) Assignee: Fox Hardwood Lumber Company, LLC, Franklin, TN (US)

( * ) Notice: Subject to any disclaimer, the term of this patent is extended or adjusted under 35 U.S.C. 154(b) by 116 days.

(21) Appl. No.: 18/108,695

(22) Filed: Feb. 13, 2023

(65) Prior Publication Data

US 2024/0271413 A1 Aug. 15, 2024

(51) Int. Cl.
*E04B 1/58* (2006.01)
*E04B 1/38* (2006.01)

(52) U.S. Cl.
CPC ..... *E04B 1/58* (2013.01); *E04B 2001/389* (2023.08)

(58) Field of Classification Search
CPC . E04B 1/1903; E04B 1/58; E04B 1/10; E04B 1/24; E04B 1/26; E04B 2001/389; E04B 2001/2415; E04B 2001/2463; E04B 2001/2644
See application file for complete search history.

(56) References Cited

U.S. PATENT DOCUMENTS 3,914,063 A * 10/1975 Papayoti ..... E04B 1/1903 403/171
4,282,693 A * 8/1981 Merklinger ..... E04H 1/02 52/282.5
5,044,134 A * 9/1991 Brockway ..... E04B 1/0007 52/79.9
8,959,857 B1 * 2/2015 Lin ..... E04H 12/2261 52/297
D852,029 S * 6/2019 Imai ..... D8/382
10,829,926 B2 * 11/2020 Adachi ..... E04B 1/2604
2022/0316203 A1 * 10/2022 Noguchi ..... E04B 1/388

FOREIGN PATENT DOCUMENTS

JP 3192371 B2 * 7/2001
JP 2006125043 * 5/2006
KR 20130059010 A * 6/2013

OTHER PUBLICATIONS

Pioneer Log Systems, Base Plates, Jun. 13, 2019, https://pioneerlogsystems.com/timber-product/base-plates/ (obtained from https://web.archive.org/web/20190613170548/https://pioneerlogsystems.com/timber-product/base-plates/) (Year: 2019).*
Simpson Strong-Tie, CPTZ Concealed Post Tie, May 15, 2016, https://www.deckbuilderoutlet.com/simpsoncptz.htm, obtained from https://web.archive.org/web/20160515150726/http://www.deckbuilderoutlet.com:80/simpsoncptz.htm (Year: 2016).*

* cited by examiner

*Primary Examiner* — Theodore V Adamos
(74) *Attorney, Agent, or Firm* — Shane Cortesi

(57) ABSTRACT

Brackets for posts and methods of using the same are described. The brackets may include a lower base plate with one or more fastener holes to connect a bracket to a support surface, an upper base plate to support a post and which may include one or more access holes aligned with the lower plate fastener holes and a knife plate that extends above the upper base plate and into a slot in the post. The brackets may also include one or more walls that extend from the lower base plate to the upper base plate to support the upper base plate. The knife plate may extend from the lower base plate through a slot in the upper base plate and may include one or more ledges that support the upper base plate.

22 Claims, 17 Drawing Sheets

ELEVATED KNIFE PLATE BRACKET

BACKGROUND

Technical Field

The present invention relates to bases or brackets designed to provide a connection between a vertical post such as one made of wood and a surface such as a concrete foundation.

Background of the Invention

Knife plates brackets are connection hardware pieces that are typically made of steel and extend vertically upward into a pre-cut slot at the bottom of heavy timber posts. Such pieces allow for connection between a structural footing, such as a concrete foundation, and heavy timber posts, for example. From its nature of being slotted into the bottom of pre-cut timber posts, knife plate brackets allow for a discrete method of securing posts. In addition, knife plate brackets also may be used to elevate the bottom of the vertical post to create a gap between the support surface and the bottom of the vertical post to prevent water damage if water runs along the support surface.

However, there is a continuing need for knife plate brackets, particularly knife plate brackets that are easy and quick to install and provide strong structural support.

SUMMARY OF THE INVENTION

The present disclosure provides an elevated knife plate bracket that may, for example, provide a connection between a wooden vertical post and concrete support surfaces, as well as methods of using same.

For example, in some embodiments, the present disclosure provides a method of securing a vertical post to a support surface. The vertical post may include a vertical post top, a vertical post bottom, a vertical post height extending from the vertical post top to the vertical post bottom, a vertical post thickness generally perpendicular to the vertical post height, a vertical post slot comprising a vertical post slot bottom located at the vertical post bottom, a vertical post slot top, and a vertical post slot height extending from the vertical post slot top to the vertical post slot top bottom generally parallel to the vertical slot height. The method may include one or more of the following steps: a) providing an elevated knife plate bracket that may include a lower base plate that may include a lower base plate bottom surface configured to rest on the support surface, a lower base plate top surface located above the lower base plate bottom surface, a lower base plate height extending from the lower base plate bottom surface to the lower base plate top surface, a lower base plate length generally perpendicular to the lower base plate height, a lower base plate width generally perpendicular to the lower base plate height and length, and a lower base plate fastener hole extending through the lower base plate from the lower base plate bottom surface to the lower base plate top surface. The lower base plate fastener hole may have a lower base plate fastener hole height generally parallel to the lower base plate height, a lower base plate fastener hole width generally perpendicular to the lower base plate fastener hole height and a lower base plate fastener hole length generally perpendicular to the lower base plate fastener hole height and width. The elevated knife plate bracket may also include an upper base plate that may be located above the lower base plate and may include an upper base plate bottom surface facing the lower base plate top surface, an upper base plate top surface located above the upper base plate bottom surface and configured to receive the bottom of the vertical post, an upper base plate height extending from the upper base plate bottom surface to the upper base plate top surface and generally parallel to the lower base plate height, an upper base plate length generally perpendicular to the upper base plate height, an upper base plate width generally perpendicular to the upper base plate height and length, and an upper base plate access hole that may extend through the upper base plate from the upper base plate bottom surface to the upper base plate top surface. The upper base plate access hole may be located directly above the lower base plate fastener hole and have an upper base plate access hole height generally parallel to the upper base plate height, an upper base plate access hole width generally perpendicular to the upper base plate access hole height and an upper base plate access hole length generally perpendicular to the upper base plate access hole height and width. The elevated knife plate bracket may also include a knife plate extending upward from the upper top plate surface at an angle of about 90 degrees relative to the upper base plate top surface. The knife plate may include a knife plate top located above the upper base plate top surface, a knife plate bottom, a knife plate height generally parallel to the upper base plate height, a knife plate front, a knife plate rear, a knife plate thickness extending from the knife plate front to the knife plate rear and generally perpendicular to the knife plate height, and at least one knife plate fastener hole located above the upper base plate top surface. The at least one knife plate fastener hole may have a length extending generally perpendicular to the upper base plate height. The knife plate fastener hole may extend through the knife plate from the knife plate front to the knife plate rear. The elevated knife plate bracket may also include a support wall that may extend between the lower base plate and the upper base plate and may at least partially support the upper base plate. The method may also include b) placing the lower base plate bottom surface on the support surface; c) placing a lower base plate fastener through the lower base plate fastener hole and into the support surface to secure the elevated knife plate bracket to the support surface; d) placing the vertical post bottom on the upper base plate top surface so that the knife plate extends upwardly into the vertical post slot; and e) placing a knife plate fastener at least partially through the vertical post thickness, and through the knife plate fastener hole to secure the vertical post to the elevated knife plate bracket.

Optionally, the knife plate bottom is located between the upper base plate bottom surface and the lower base plate top surface. Optionally, the upper base plate comprises an upper base plate knife plate slot that extends from the upper base plate top surface to the upper base plate bottom surface and has an upper base plate knife plate slot height generally parallel to the upper base plate height, an upper base plate knife plate slot width generally perpendicular to the upper base plate knife plate slot height, and an upper base plate knife plate slot length generally perpendicular to the upper base plate knife plate slot height and width. Optionally, the upper base plate knife plate slot length is larger than the upper base plate knife plate slot height and width. Optionally, the knife plate extends from the lower base plate through the upper base plate knife plate slot and at least two inches above the upper base plate top surface.

Optionally, the knife plate comprises a knife plate left side, a knife plate right side, a knife plate width extending from the knife plate left side to the knife plate right side and generally perpendicular to the knife plate thickness and the knife plate height. Optionally, the knife plate comprises a knife plate upper portion located above the upper base plate top surface, a knife plate laterally extended portion located below the upper base plate bottom surface. Optionally, the knife plate upper portion and the knife plate laterally extended portion each have a width generally parallel to the knife plate width. Optionally, the knife plate laterally extended portion comprises a top comprising a top ledge located adjacent to the upper base plate knife plate slot, confronting the upper base plate bottom surface and at least partially supporting the upper base plate. Optionally, the width of the knife plate laterally extended portion is greater than the upper base plate knife plate slot length and the knife plate upper portion width.

Optionally, the top ledge comprises a left top ledge located to the left of the upper base plate knife plate slot and confronting the upper base plate bottom surface, and a right top ledge located to the right of the upper base plate knife plate slot and confronting the upper base plate bottom surface.

Optionally, the lower base plate bottom further comprises a lower base plate knife plate slot receiving the knife plate bottom. Optionally, the lower base plate knife plate slot has a lower base plate knife plate slot height generally parallel to the lower base plate height, a lower base plate knife plate slot width generally perpendicular to the lower base plate knife plate slot height, a lower base plate knife plate slot length generally perpendicular to the lower base plate knife plate slot height and width. Optionally, the lower base plate knife plate slot length is larger than the lower base plate knife plate slot height and width. Optionally, the knife plate laterally extended portion comprises a bottom comprising a bottom ledge located adjacent to the lower base plate knife plate slot and confronting the lower base plate top surface. Optionally, the width of the knife plate laterally extended portion is greater than the lower knife base plate knife plate slot length and the knife plate upper portion width.

Optionally, the bottom ledge comprises a left bottom ledge located to the left of the lower base plate knife plate slot and confronting the lower base plate top surface, and a right bottom ledge located to the right of the lower base plate knife plate slot and confronting the lower base plate top surface.

Optionally, the support wall comprises a support wall top a support wall, a support wall bottom, and a support wall height generally parallel to the upper and lower base plate heights. Optionally, the access hole comprises an access hole support wall slot. Optionally, the lower base plate comprises a lower base plate support wall slot. Optionally, the support wall top is located in the access hole support wall slot. Optionally, the support wall bottom is located in the lower base plate support wall slot.

Optionally, the support wall comprises a support wall wide portion comprising a support wall top ledge located below the support wall top and a support wall bottom ledge located below the support wall top ledge. Optionally, the support wall top ledge confronts and at least partially supports the upper base plate. Optionally, the support wall bottom ledge confronts the lower base plate top surface.

Optionally, the support wall wide portion is C-shaped.

Optionally, the upper base plate comprises a plurality of upper base plate access holes. Optionally, the lower base plate comprises a plurality of lower base plate fastener holes.

Optionally, each lower base plate fastener hole is located directly below an upper base plate access hole, wherein each lower base plate fastener hole is generally circular in shape and comprises a diameter. Optionally, each respective upper base plate access hole has a length and/or width that is greater than the diameter of the respective lower base plate fastener hole with which the upper base plate access hole is aligned.

Optionally, at least one of the upper base plate access holes is located in front of the knife plate front. Optionally, at least one of the upper base plate access holes is located to the rear of the knife plate rear.

Optionally, the elevated knife plate bracket comprises four upper base plate access holes and four lower base plate fastener holes. Optionally, each lower base plate fastener hole is located directly below an upper base plate access hole.

Optionally, the upper base plate is located directly above the lower base plate.

Optionally, the upper base plate width is generally parallel to and substantially equal in size to the lower base plate width and the upper base plate length is generally parallel to and substantially equal in size to the lower base plate length.

Optionally, the upper base plate bottom surface is located between about 1 and about 3 inches above the lower base plate top surface.

Optionally, the lower base plate fastener hole is generally circular in shape. Optionally, the support wall is semi-cylindrical in shape and partially surrounds the lower base plate fastener hole.

Optionally, the upper base plate access hole is generally circular in shape and comprises a circumference. Optionally, the support wall extends partially around the circumference of the upper base plate access hole.

Optionally, the knife plate is located approximately in the center of the upper base plate width and/or upper base plate length.

Optionally, step e) comprises placing a knife plate fastener through a first side of the vertical post, through the knife plate fastener hole, out the second side of the vertical post to secure the vertical post to the elevated knife plate bracket.

Optionally, the support surface is comprised of concrete and optionally the lower base plate fastener is rebar.

Optionally, the vertical post is comprised of wood.

Optionally, the lower base plate fastener is L-shaped.

Optionally, the knife plate fastener is oriented perpendicular to the upper and lower base plate heights.

Optionally, the knife plate, the support wall, the lower base plate and the upper base plate are comprised of metal. Optionally, the knife plate is welded to the lower base plate and the support wall is welded to the lower base plate and the upper base plate.

Optionally, the knife plate height is at least five times greater than each of the lower base plate and upper base plate heights.

Optionally, each of the lengths and widths of the upper and lower base plates is at least five times greater than the heights of each of the upper and lower base plates.

Optionally, the knife plate height is at least five times greater than the knife plate thickness.

Optionally, the upper base plate top surface is configured to support a vertical post bearing a load of at least one hundred pounds.

Optionally, the lower base plate bottom surface is generally flat, not considering the fastener holes, such that the lower base plate bottom surface is generally flush against the support surface upon which it is placed.

Optionally, the upper base plate top surface is generally flat, not considering the access holes, such that the upper base plate top surface is generally parallel to the support surface above which it rests.

Optionally, the knife plate fastener is a dowel.

Optionally, the knife plate fastener hole comprises three knife plate fastener holes arranged in the pattern of an isosceles triangle.

In still further embodiments, the present disclosure provides an elevated knife plate bracket that includes one or more features described above.

DETAILED DESCRIPTION

Figure 1:
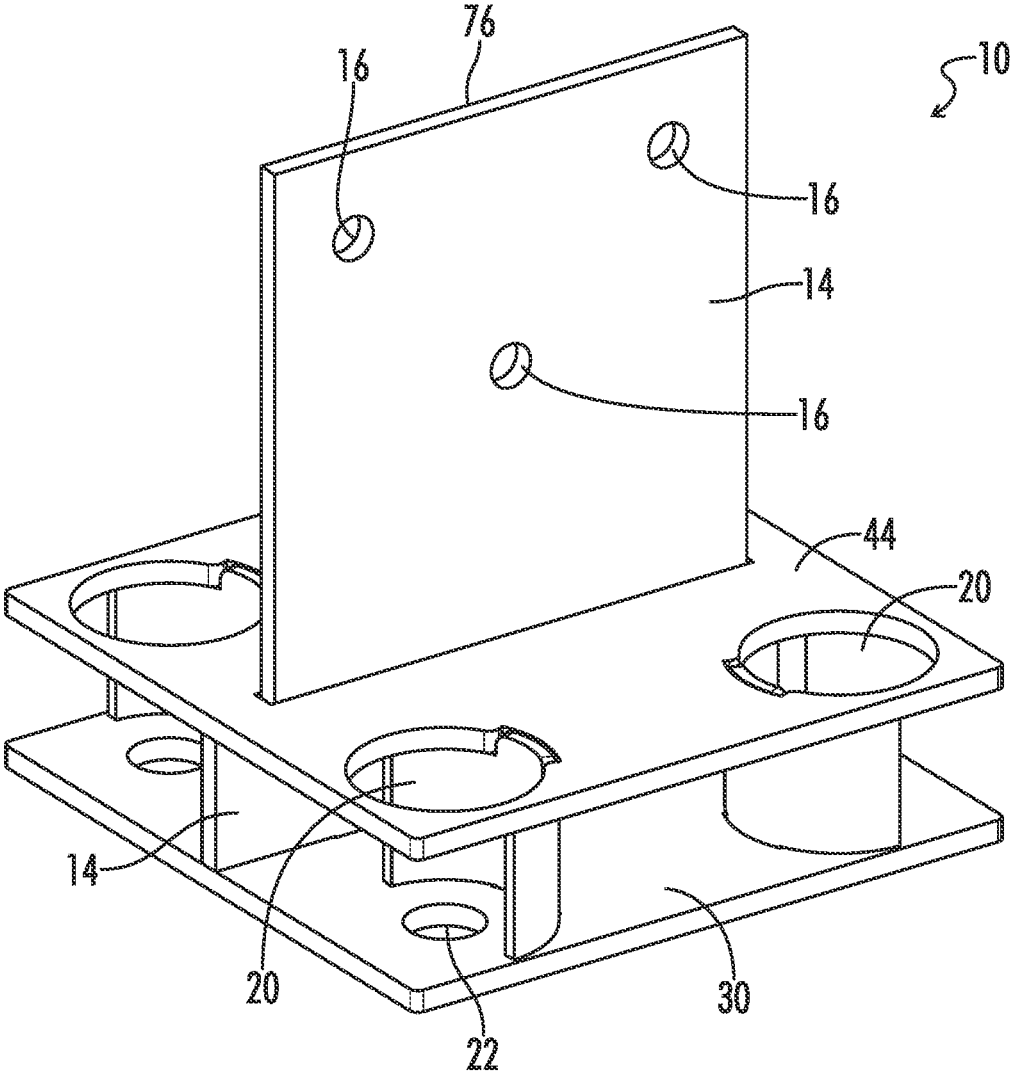
FIG. 1 illustrates a front top left perspective view of the elevated knife plate bracket in accordance with one embodiment of the present invention.
Figure 2:
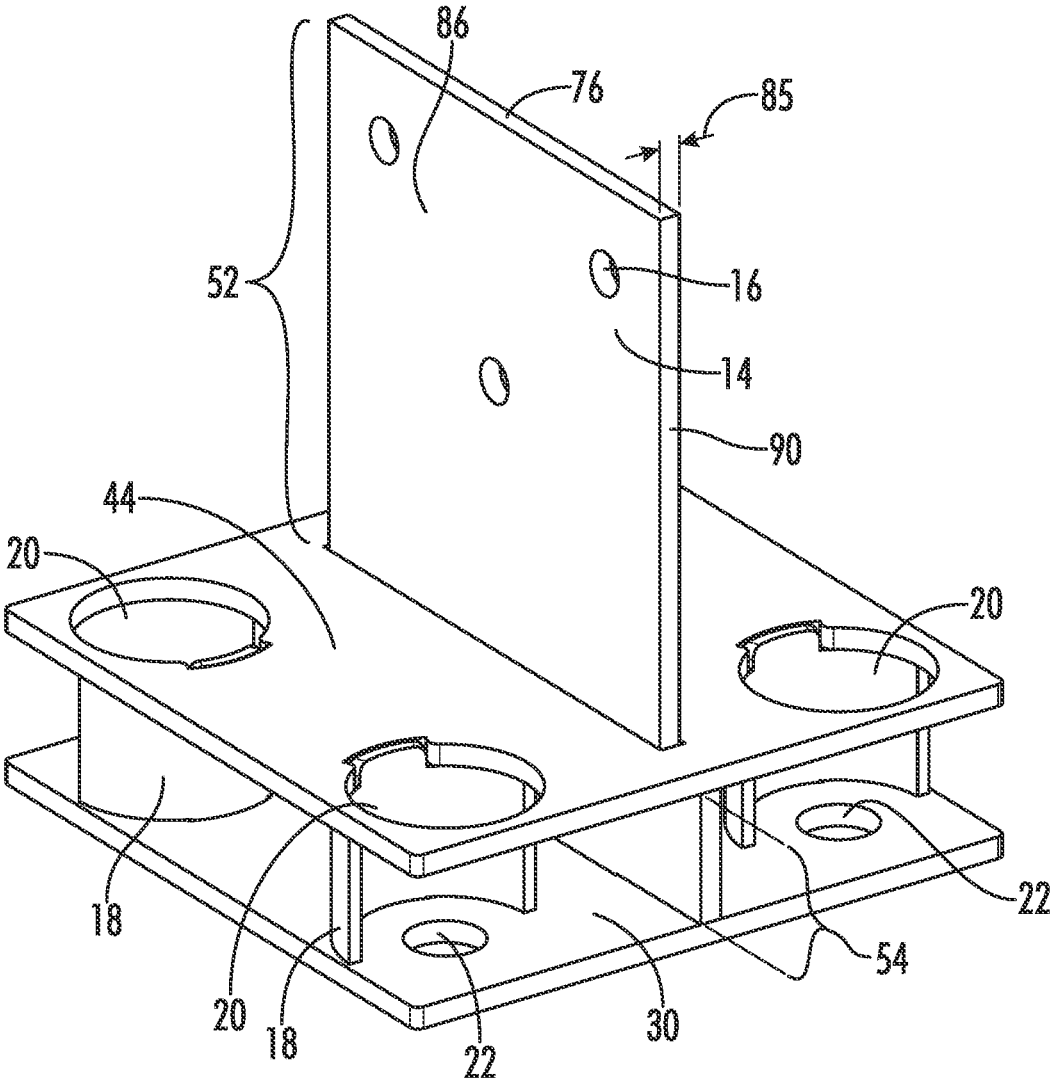
FIG. 2 illustrates a rear top left perspective view of the elevated knife plate bracket of FIG. 1.
Figure 3:
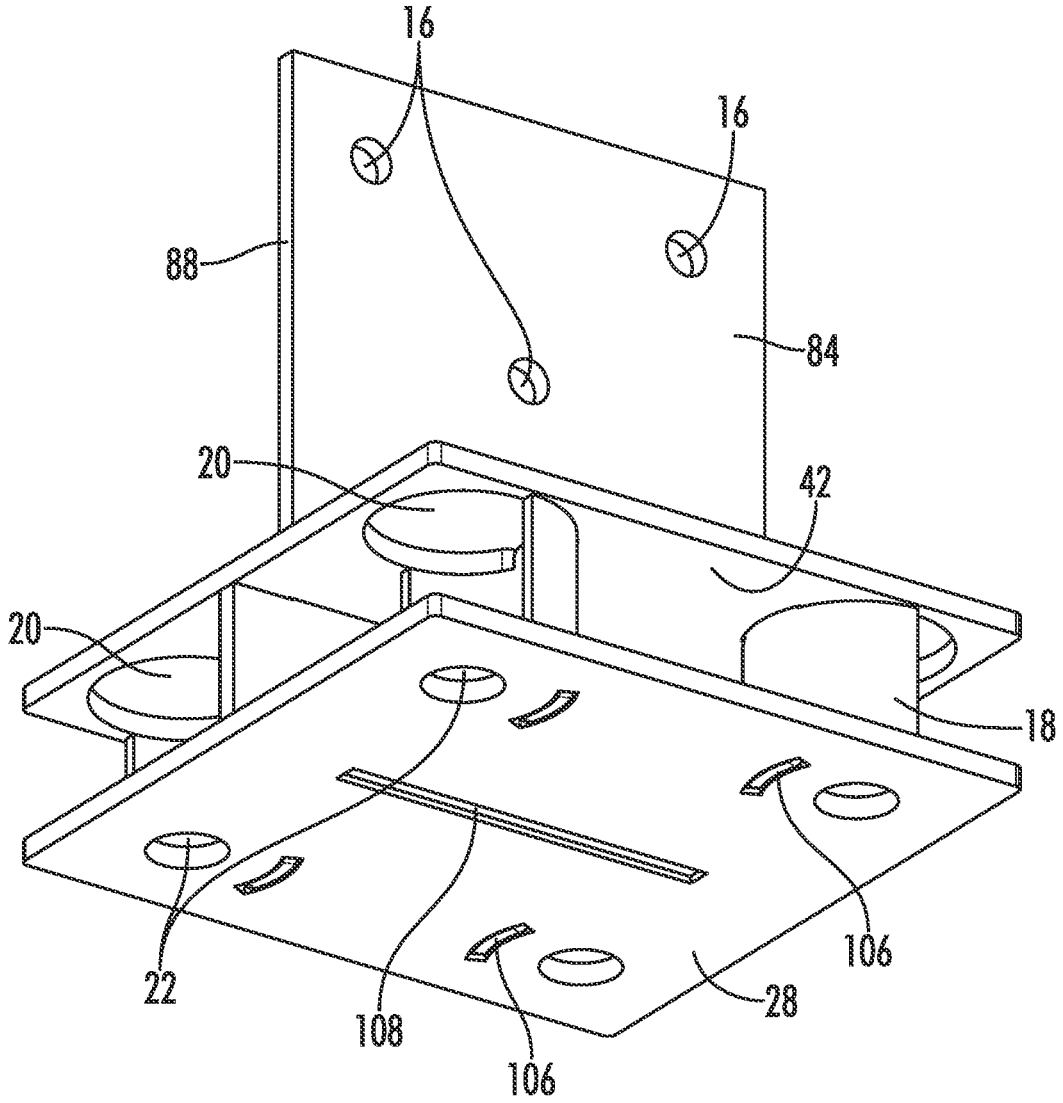
FIG. 3 illustrates a front bottom left perspective view of the elevated knife plate bracket of FIG. 1.
Figure 4:
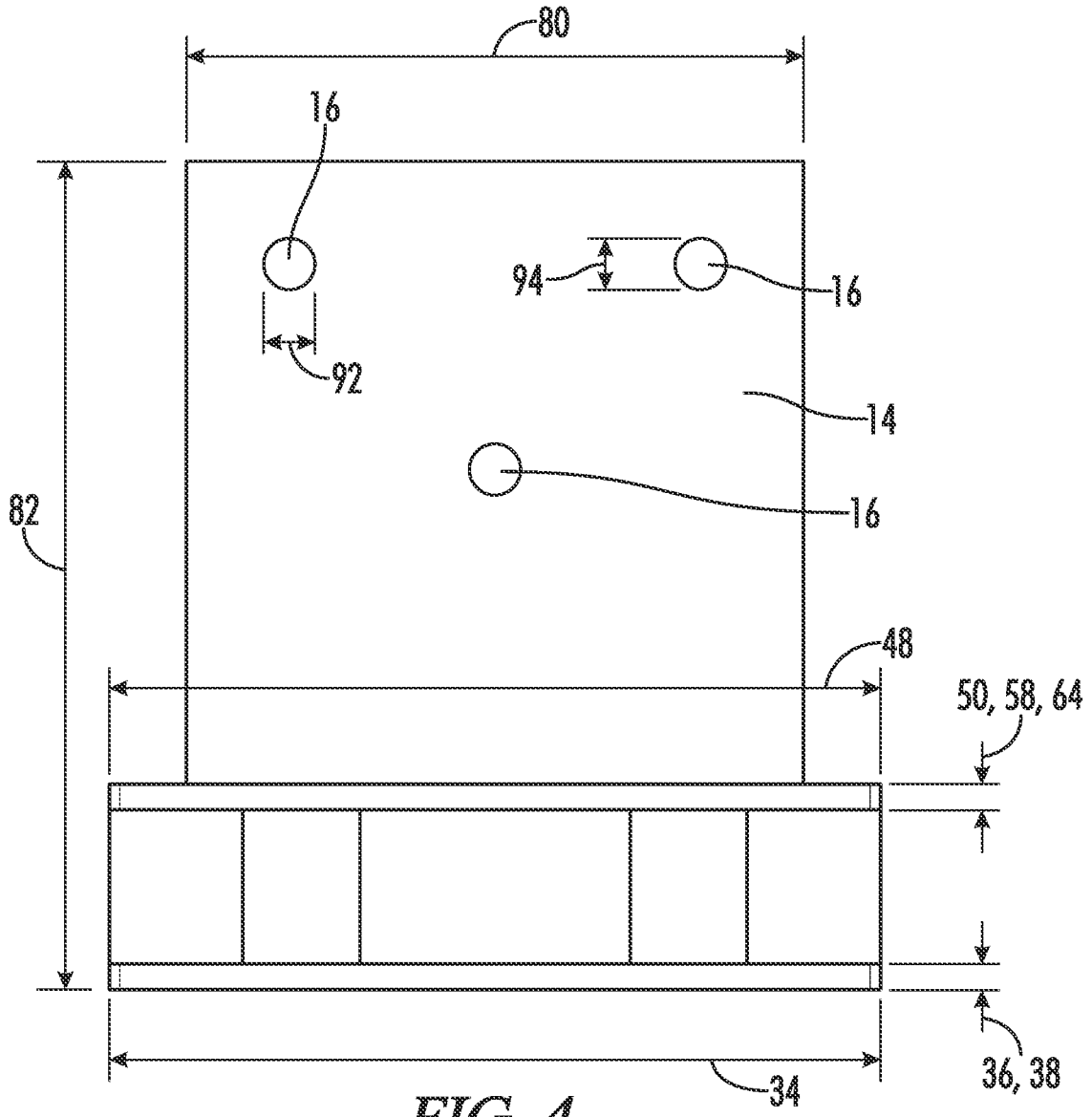
FIG. 4 illustrates a front elevation view of the elevated knife plate bracket of FIG. 1.
Figure 5:
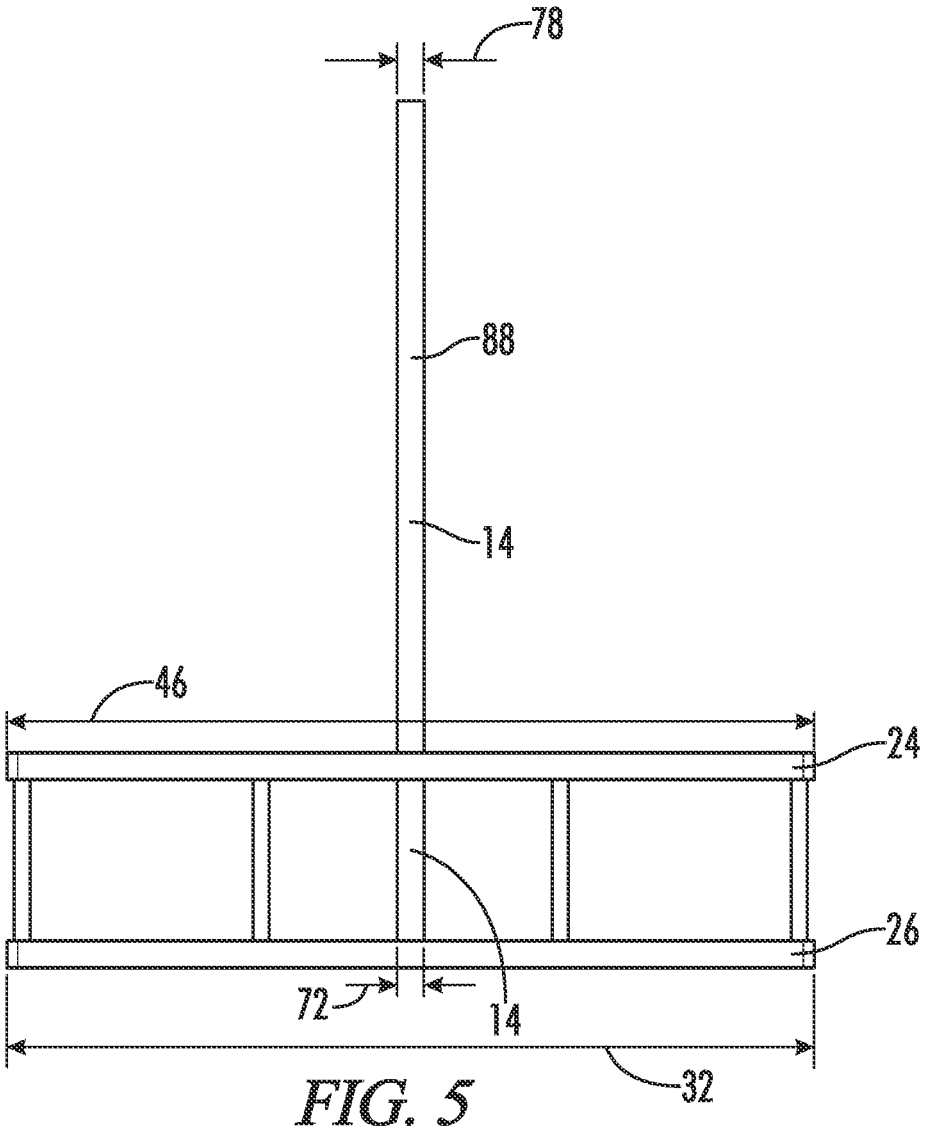
FIG. 5 illustrates a left elevation view of the elevated knife plate bracket of FIG. 1.

With reference to FIGS. 1-19, the present disclosure provides an elevated knife plate bracket generally designated by the numeral 10 and also referred to herein as "the bracket 10". In the drawings, not all reference numbers are included in each of the drawings for the sake of clarity. FIGS. 1-19 are CAD drawings drawn to scale, however, it will be appreciated that other dimensions are possible.

Referring further to FIGS. 1-19, the bracket 10 may be configured to secure a vertical post 12 to a support surface 11. Optionally, the support surface 11 is concrete, and the vertical post 12 is wood.

As shown in FIGS. 1-19, the vertical post 12 may include a vertical post top 126, a vertical post bottom 128, a vertical post slot 122, a vertical post height 130 extending from the vertical post top 126 to the vertical post bottom 128, a vertical post thickness 130 generally perpendicular to the vertical post height 132, a vertical post slot 122 having a vertical post slot bottom 136 located at the vertical post bottom 128, a vertical post slot top 138 below the vertical post top 126, a vertical post slot height 134 extending from the vertical post slot bottom 136 to the vertical post slot top 138 and generally parallel to (and shorter than) the vertical post height 132 and a vertical post fastener hole 124. It will be understood that the singular embraces the plural. Thus, for example, the vertical post 12 may include a plurality of vertical post fastener holes 124.

As shown in FIGS. 1-19, the bracket 10 may include a knife plate 14, an upper base plate 24, a lower base plate 26 and at least one support wall 18.

As shown in FIGS. 1-19, the lower base plate 26 may include a lower base plate top surface 30, a lower base plate bottom surface 28 located below the lower base plate top surface 30 and configured to rest on the support surface 11, a lower base plate height 36 extending from the lower base plate bottom surface 28 to the lower base plate top surface 30, a lower base plate length 34 generally perpendicular to the lower base plate height 36, and a lower base plate width 32 generally perpendicular to both a lower base plate length 34 and a lower base plate height 36.

As shown in FIGS. 1-19, the lower base plate 26 may include at least one, preferably a plurality of, fastener holes 22 that may extend through the lower base plate 26 from the lower base plate bottom surface 28 to the lower base plate top surface 26. The fastener holes 22 may comprise fastener hole heights 38 generally parallel to the lower base plate height 36, and fastener hole widths 40 generally perpendicular to the fastener hole heights 38, as well as fastener hole lengths 41 generally perpendicular to the fastener hole heights 38 and widths 40.

As shown in FIGS. 1-19, the upper base plate 24 may be located above the lower base plate 26 and may include an upper base plate top surface 44 configured to receive the vertical post bottom 128, an upper base plate bottom surface 42 located below the upper base plate top surface 44 and facing the lower base plate top surface 30, an upper base plate height 50 extending from the upper base plate top surface 44 to the upper base plate bottom surface 42 and generally parallel to the lower base plate height 36, an upper base plate length 48 generally perpendicular to the upper base plate height 50, and an upper base plate width 46 generally perpendicular to the upper base plate length 48 and upper base plate height 48.

As shown in FIGS. 1-19, the upper base plate 24 may also include at least one, preferably a plurality of, access hole(s) 20 that extend through the upper base plate 24 from the upper base plate bottom surface 42 to the upper base plate top surface 44. Each upper base plate access hole 20 may be located directly above a lower base plate fastener hole 22 and have an upper base plate access hole height 64 generally parallel to the upper base plate height 48, an upper base plate access hole width 66 generally perpendicular to the upper base plate access hole height 64 and an upper base plate access hole length 67 generally perpendicular to the upper base plate access hole height 64 and width 66. Without being bound by any particular theory, the upper base plate access hole 20 may facilitate access to placing and tightening the fastener 120 located in the lower base plate fastener hole 22.

As shown in FIGS. 1-19, the knife plate 14 may extend upward from the upper top plate surface 44 at an angle of about 90 degrees relative to the upper base plate top surface 44, and may include a knife plate top 76 located above the upper base plate top surface 44, a knife plate bottom 70, a knife plate height 82 generally parallel to the upper base plate height 48, a knife plate front 84, a knife plate rear 86, a knife plate thickness 85 extending from the knife plate front 84 to the knife plate rear 86 and generally perpendicular to the knife plate height 82 and, at least one knife plate fastener hole 16 located above the upper base plate top surface 44. The at least one knife plate fastener hole 16 may have a length 92 extending generally perpendicular to the upper base plate height 48. The knife plate fastener hole 16 may extend through the knife plate 14 from the knife plate front 84 to the knife plate rear 86.

As shown in FIGS. 1-19, the support wall 18 may extend between the lower base plate 26 and the upper base plate 24 and at least partially support the upper base plate 24.

As shown in FIGS. 1-19, the knife plate bottom 70 may be located between the upper base plate bottom surface 42 and the lower base plate top surface 30.

As shown in FIGS. 1-19, the upper base plate 24 may include an upper base plate knife plate slot 56 that extends from the upper base plate top surface 44 to the upper base plate bottom surface 42. The upper base plate knife plate slot 56 may comprise an upper base plate knife plate slot height 58 generally parallel to the upper base plate height 48, an upper base plate knife plate slot width 60 generally perpendicular to the upper base plate knife plate slot height 58, and an upper base plate knife plate slot length 62 generally perpendicular to the upper base plate knife plate slot height 58 and width 60. The upper base plate knife plate slot length 62 may be greater than the upper base plate knife plate slot height 58 and width 60. In addition, the knife plate 14 may extend from the lower base plate 26 through the upper base plate knife plate slot 56 and at least two inches above the upper base plate top surface 44. In other words, the knife plate top 76 may be located at least two inches above the upper base plate top surface 44.

As shown in FIGS. 1-19, the knife plate 14 may include a knife plate left side 88, a knife plate right side 90, a knife plate width 78 extending from the knife plate left side 88 to the knife plate right side 90, and generally perpendicular to the knife plate thickness 85 and the knife plate height 82. Further, the knife plate 14 may comprise a knife plate upper portion 52 located above the upper base plate top surface 44, a knife plate laterally extended portion 54 located below the upper base plate bottom surface 42, the knife plate upper portion 52 and the knife plate laterally extended portion 54 each having a width generally parallel to the knife plate top width 78. Further, as seen in FIG. 8 for example and also shown but not labelled in FIGS. 19A-19D, the knife plate laterally extended portion 54 may comprise a top ledge 116 located adjacent to the upper base plate knife plate slot 56 which may confront the upper base plate bottom surface 42 and at least partially support the upper base plate 24. The width of the knife plate laterally extended portion 54 may be greater than the upper base plate knife plate slot length 62 and the knife plate upper portion width 78.

As seen in FIGS. 6-8 and 19A-19D for example, the lower base plate 26 may comprise a lower base plate knife plate slot 108 configured to receive the knife plate bottom 70. The lower base plate knife plate slot 108 may include a lower base plate knife plate slot height 110 generally parallel to the lower base plate height 36, a lower base plate knife plate slot width 114 generally perpendicular to the lower base plate knife plate slot height 110, a lower base plate knife plate slot length 112 generally perpendicular to the lower base plate knife plate slot height 110 and width 114. The lower base plate knife plate slot length 112 may be larger than the lower base plate knife plate slot height 110 and width 114. Further, the knife plate laterally extended portion may comprise a bottom ledge 118 located adjacent to the lower base plate knife plate slot 108 and which may confront the lower base plate top surface 30, and the width of the knife plate laterally extended portion 54 may be greater than the lower knife base plate knife plate slot length 112 and the knife plate upper portion width 78.

As seen in FIGS. 8 and 19A-19D for example the support wall(s) 18 may comprise a support wall top 96 and a support wall bottom 98. The access hole(s) 20 may comprise an access hole support wall slot 68, the lower base plate 26 may comprise a lower base plate support wall slot 106. The support wall top 96 may be configured to slot into the access hole support wall slot 68 of upper base plate 24 and the support wall bottom 98 may be configured to slot into the lower base plate support wall slot 106 of lower base plate 26. In other words, the support wall 18 may attach to the upper and lower base plates 24 and 26 using a tab and slot feature (with the tabs being on the support wall top 96 and bottom 98 and the slots being the access hole support wall slot 68 and the lower base plate support wall slot 106). The support wall 18 may further comprise a support wall wide portion 104 which may comprise a support wall top ledge 100 located below the support wall top 96 and a support wall bottom ledge 102 located below the support wall top ledge 100. The support wall top ledge 100 may confront and at least partially support the upper base plate 24, and the support wall bottom ledge 102 may confront the lower base plate top surface 30. Optionally, the support wall wide portion 104 is semi-cylindrical (e.g., C-shaped). As shown in FIGS. 1-19, the knife plate 14, the support wall 18, the lower base plate 26 and the upper base plate 24 may be comprised of metal, and further, the knife plate 14 may be welded to the lower base plate 26 and the support wall 18 may be welded to both the lower base plate 26 and the upper base plate 24.

As seen in FIGS. 6-8 and 19A-19D for example, the upper base plate 24 may comprise a plurality of access holes 20, and the lower base plate 26 may comprise a plurality of fastener holes 22.

As shown in the embodiment in FIGS. 1-19, each fastener hole 22 in the lower base plate 26 may be located directly below an access hole 20 in the upper base plate 24. Further, each fastener hole 22 may be generally circular in shape and may comprise a fastener hole width 40, a fastener hole length 41, and a fastener hole height 38. Further, each fastener hole 22 may have a width 40 and length 41 that is less than the width and length of the respective access hole 20 in the upper base plate 24 with which each fastener hole 20 is aligned.

As shown in FIGS. 1-19 at least one of the access holes 20 in the upper base plate 24 may be located in front of the knife plate front 84 and at least one access holes 20 may be located to the rear of the knife plate rear 86. In other words, as shown in FIGS. 1-19, the knife plate 14 may be located between at least some of the access holes 20, where two access holes 20 are located in front of the knife plate front 84 and two access holes 20 are located to the rear of the knife plate rear 86.

For example, in the embodiment depicted in FIGS. 1-19, the bracket 10 comprises four access holes 20 in the upper base plate 24 and four fastener holes 24 in the lower base plate 26. Further, each fastener hole 24 is located directly below an access hole 20.

As shown in FIGS. 1-19, the upper base plate 24 may be located directly above the lower base plate 26.

As shown in FIGS. 1-19, the upper base plate width 46 may be generally parallel to and substantially equal in size to the lower base plate width 32 and the upper base plate length 48 may be generally parallel to and substantially equal in size to the lower base plate length 34.

As shown in FIGS. 1-19, the upper base plate 24 and the lower base plate 26 may be generally rectangular in shape.

As shown in FIGS. 1-19, the upper base plate bottom surface 42 may be located between about 1-3 inches above the lower base plate top surface 30.

Figure 7:
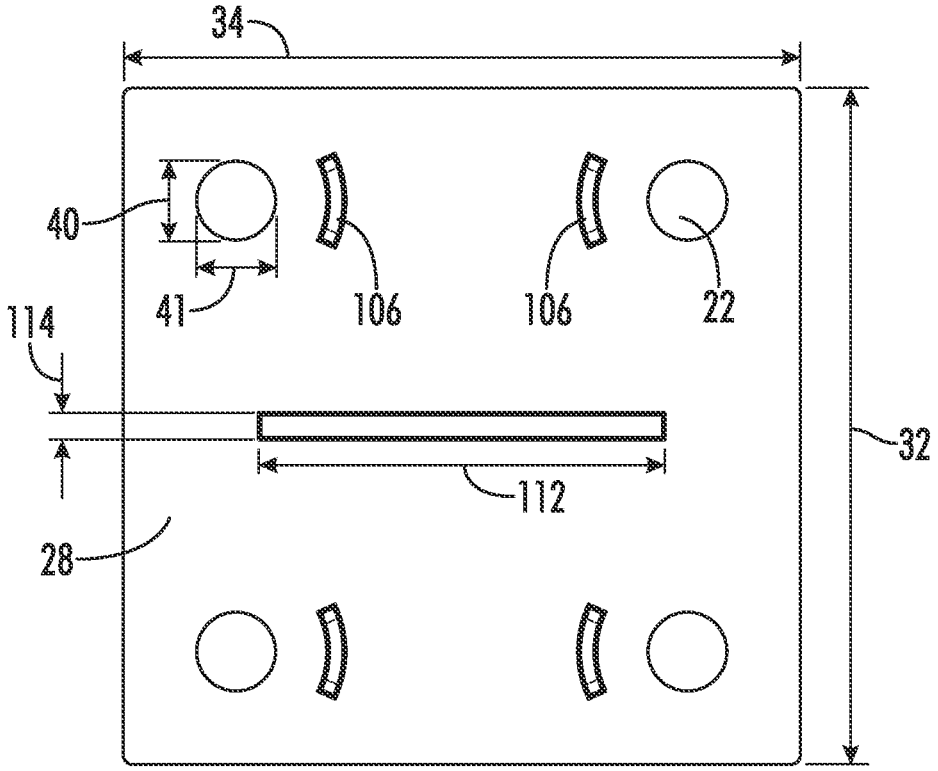
FIG. 7 illustrates a bottom plan view of the elevated knife plate bracket of FIG. 1.
Figure 8:
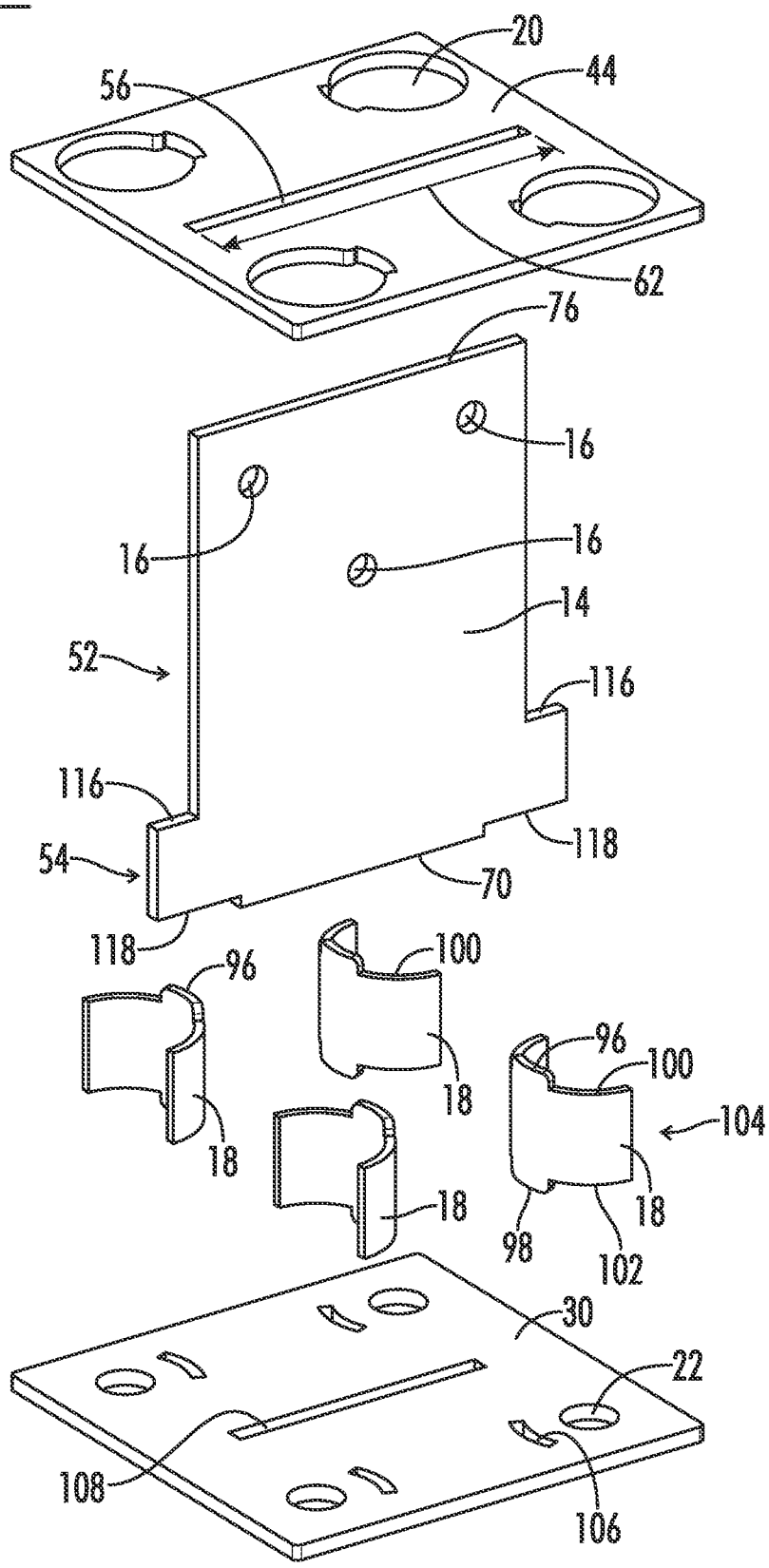
FIG. 8 illustrates an exploded front top left perspective view of the elevated knife plate bracket in FIG. 1.
Figure 18:
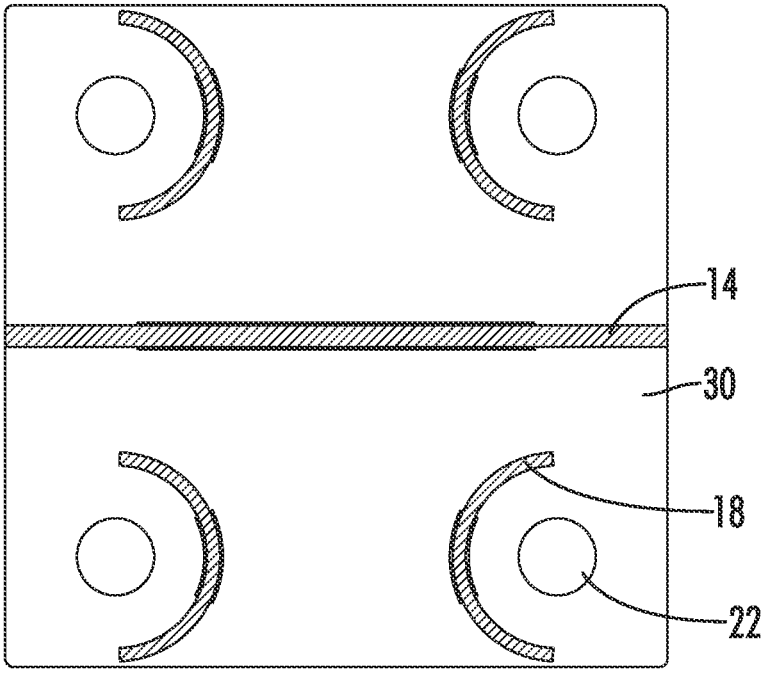
FIG. 18 illustrates a sectional view of the elevated knife plate bracket of FIG. 17 taken along line 18-18 of FIG. 17.
Figure 19A:
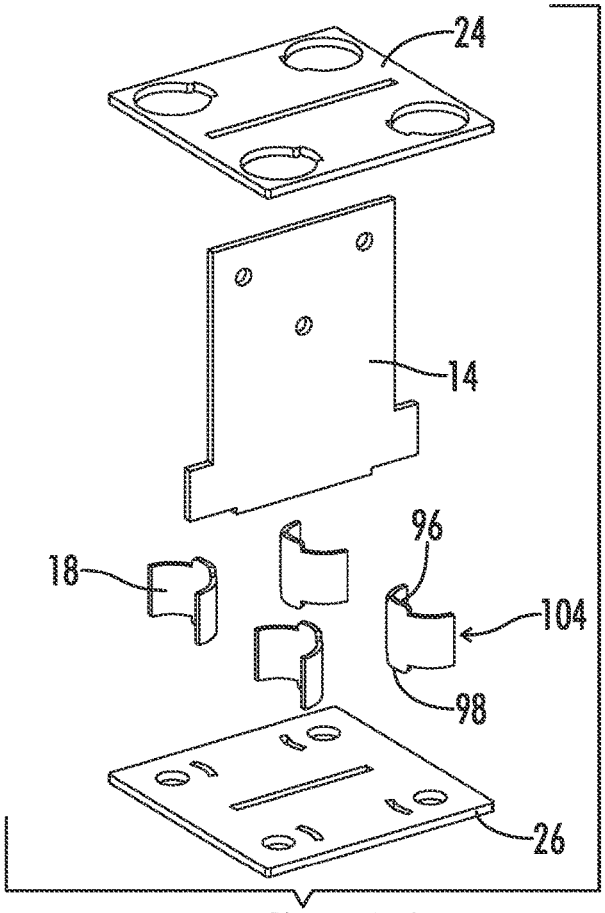
FIG. 19A illustrates a top left perspective, fully exploded view of the bracket of FIG. 1 without the fasteners.
Figure 19B:
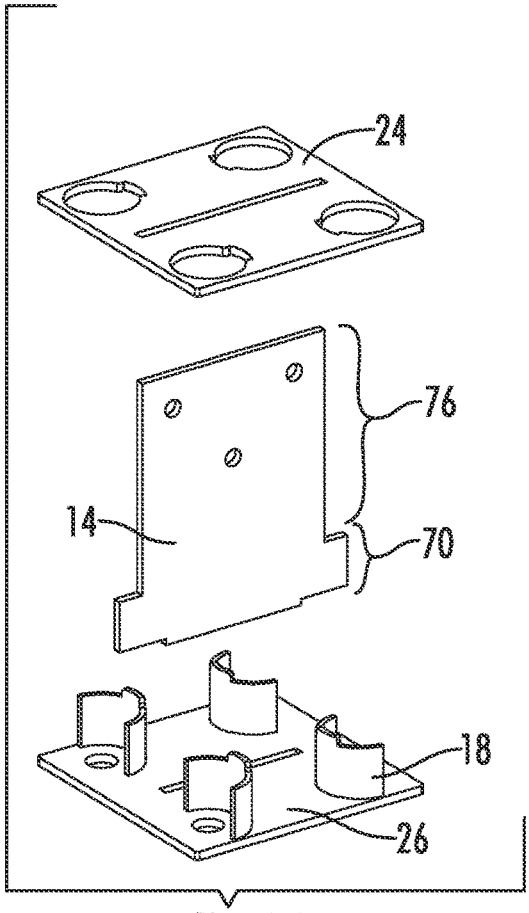
FIG. 19B illustrates a top left perspective, partially exploded view of the bracket of FIG. 19A.
Figure 19C:
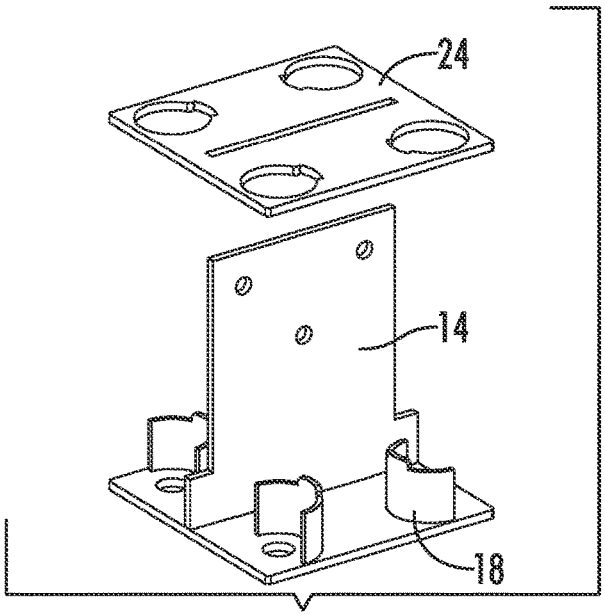
FIG. 19C illustrates another top left perspective, partially exploded view of the bracket of FIG. 19A.
Figure 19D:
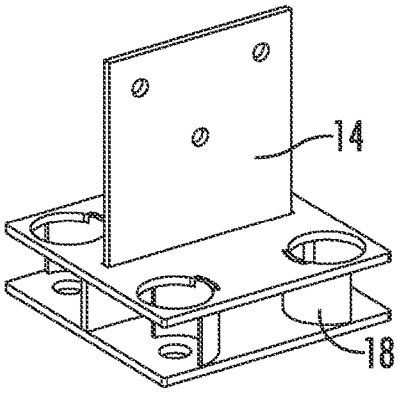
FIG. 19D illustrates another top left perspective, partially exploded view of the bracket of FIG. 19A.

As seen in FIGS. 7 and 18 for example, the plurality of fastener holes 22 in the lower base plate 26 may be generally circular in shape. Further, the plurality of support walls 18 may be semi-cylindrical in shape (e.g., C-shaped), as to partially surround the fastener holes 22.

As shown in FIGS. 1-19, the support wall 18 may extend partially around the access hole 20 in the upper base plate 24.

Figure 6:
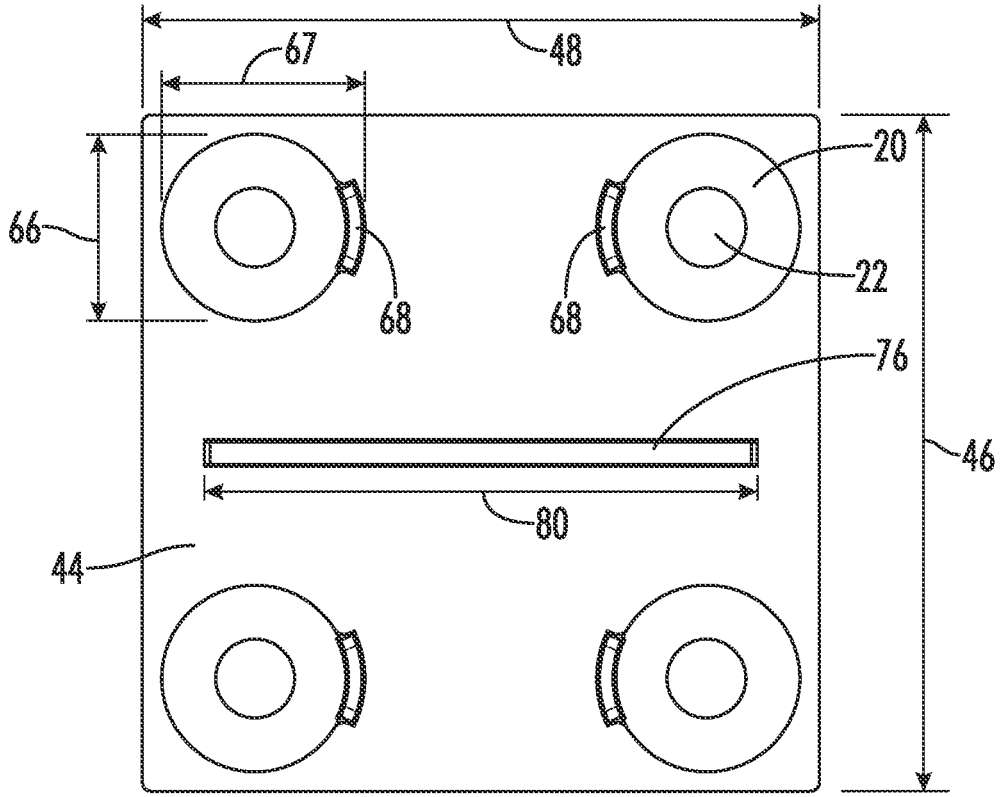
FIG. 6 illustrates a top plan view of the elevated knife plate bracket of FIG. 1.

As seen in FIG. 6 for example, access hole 20 may be generally circular in shape and may include an access hole width 66, an access hole length 48, and an access hole height 36.

As shown in FIGS. 1-19, the knife plate 14 may be located approximately in the center of the upper base plate width 46 and/or upper base plate length 48.

As shown in FIGS. 1-19, the lower base plate bottom surface 28 may be generally flat, not considering any number of fastener holes 22, such that the lower base plate bottom surface 28 is generally flush against the support surface 11 upon which it is placed.

As shown in FIGS. 1-19, the upper base plate top surface 44 may be generally flat, not considering any number of access holes 20, such that the upper base plate top surface 44 is generally parallel to the support surface 11 above which it rests.

Optionally, support surface 11 is comprised of concrete. Optionally, the vertical post 12 is comprised of wood.

Figure 11:
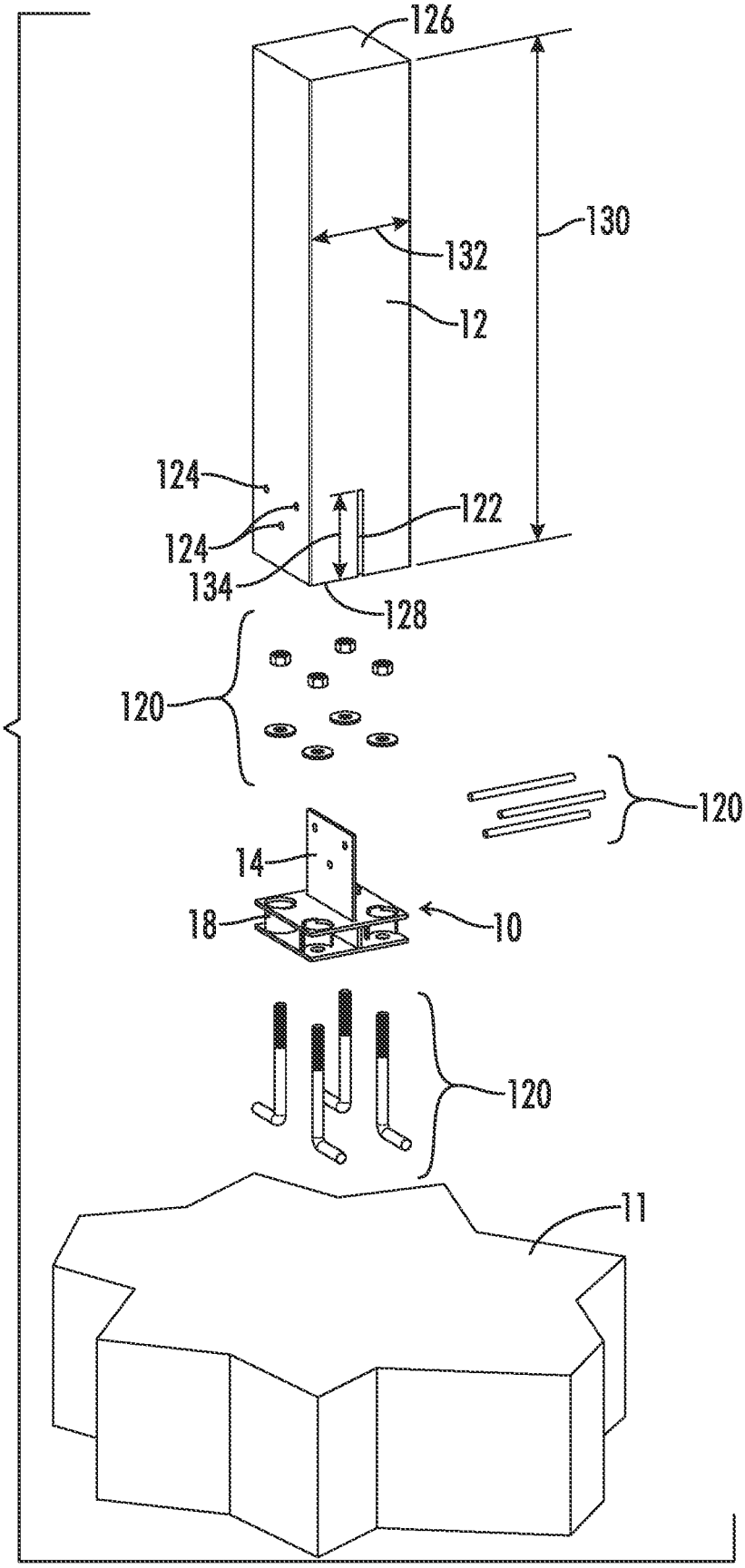
FIG. 11 illustrates a side perspective, exploded view of the elevated knife plate bracket of FIG. 1 in the process of joining a wooden post and a concrete support surface.
Figure 12:
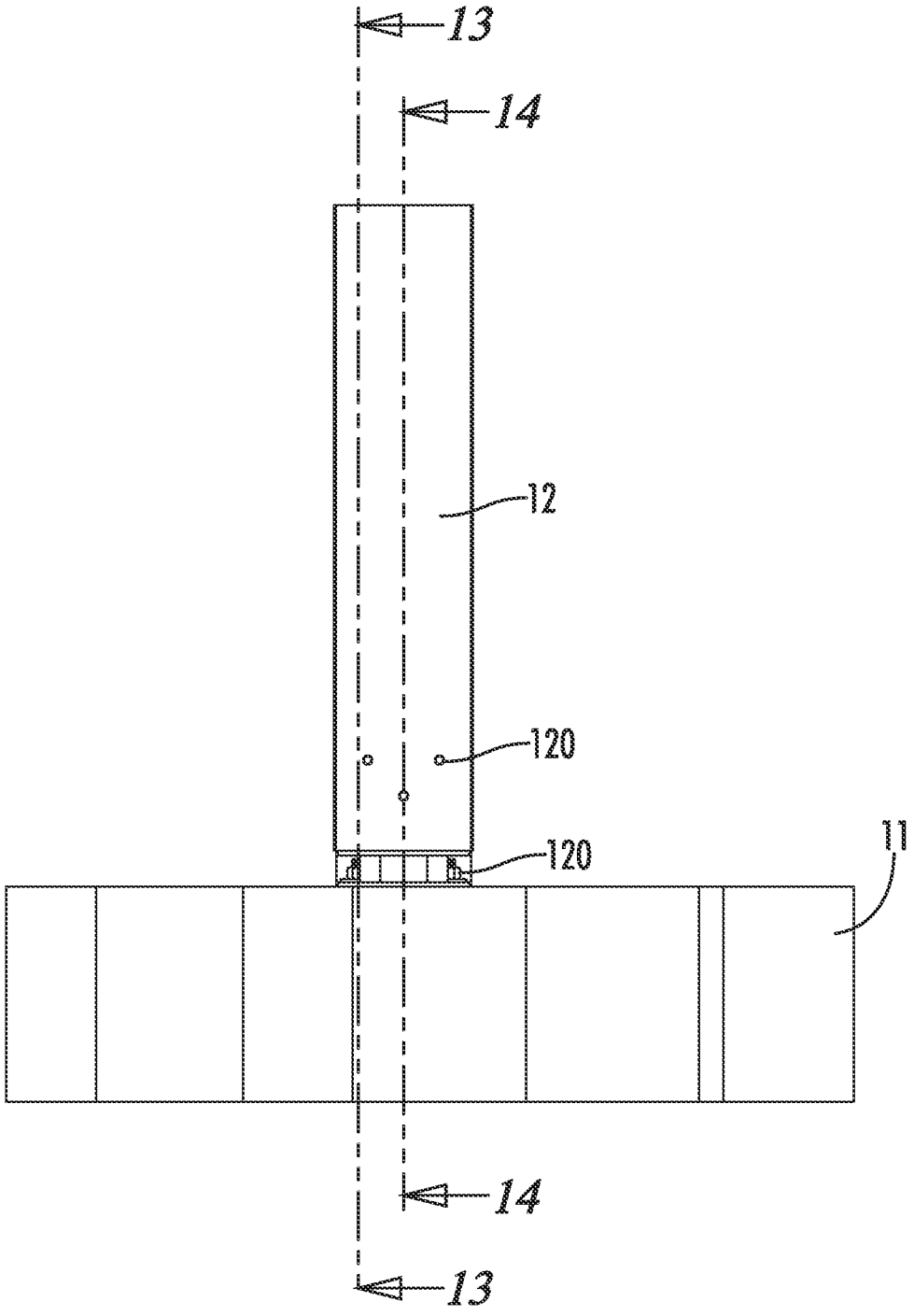
FIG. 12 illustrates a side elevation, assembled view of the elevated knife plate bracket, wooden post and concrete support of FIG. 11.
Figure 13:
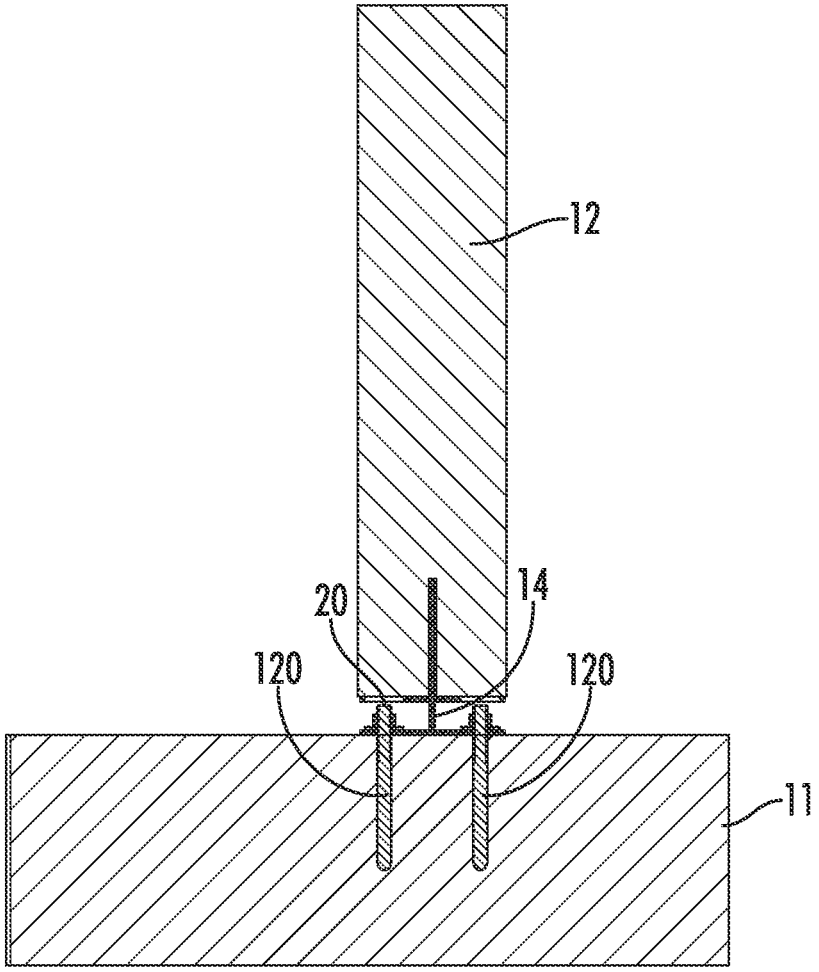
FIG. 13 illustrates a sectional view of the elevated knife plate bracket, wooden post and concrete support of FIG. 12 taken along line 13-13 of FIG. 12.
Figure 14:
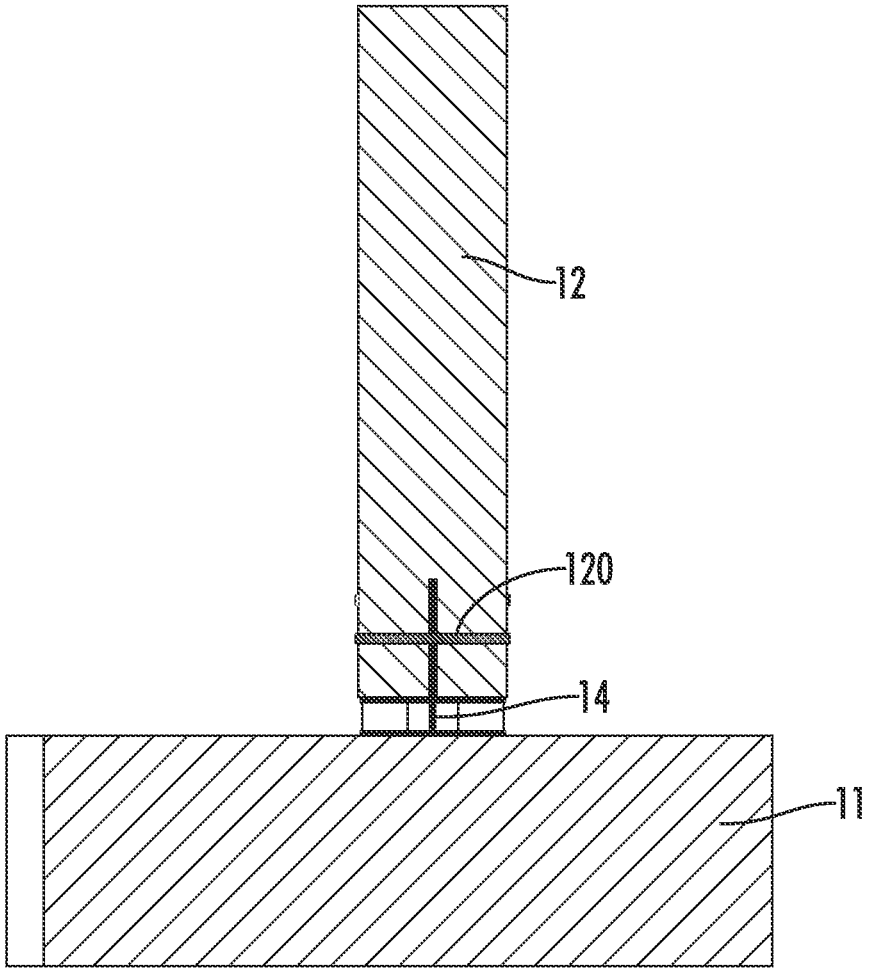
FIG. 14 illustrates a sectional view of the elevated knife plate bracket, wooden post and concrete support of FIG. 12 taken along line 14-14 of FIG. 12.
Figure 15:
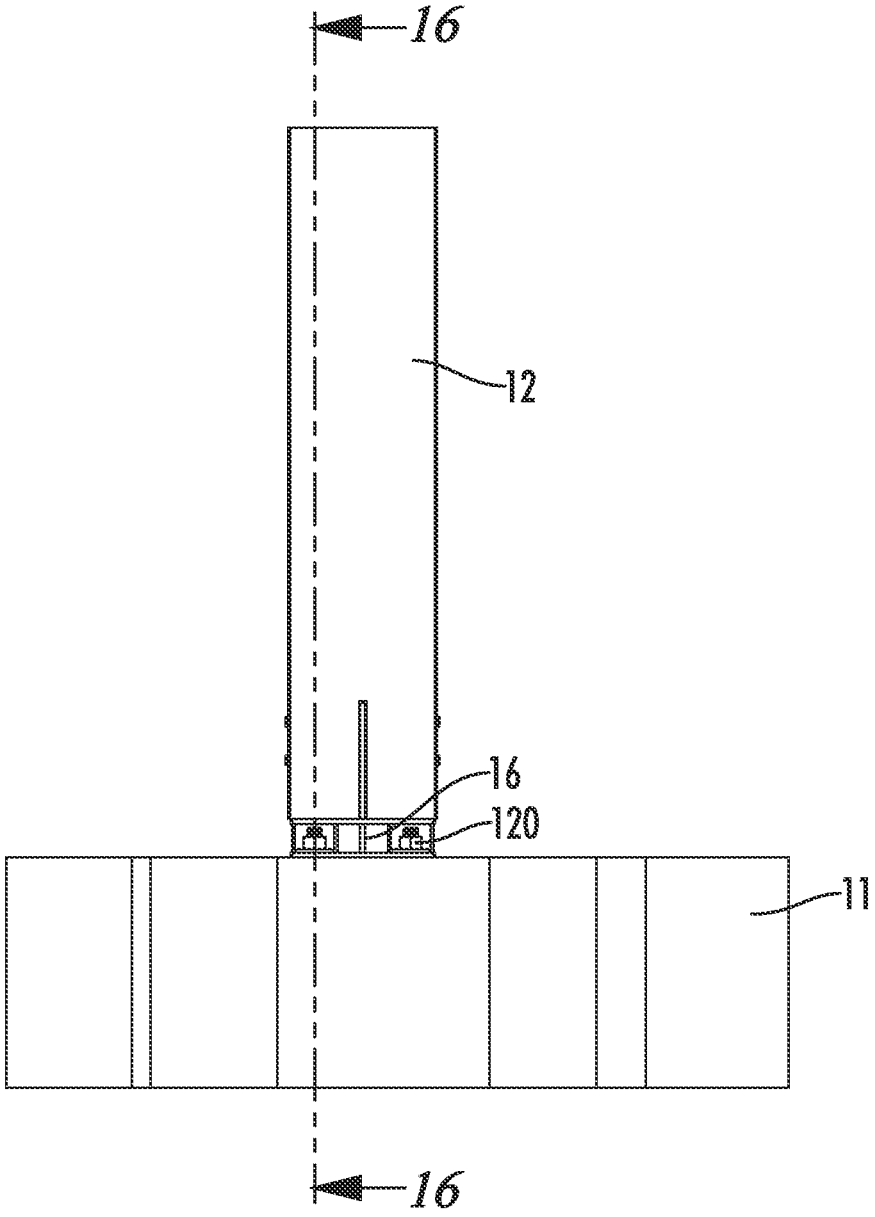
FIG. 15 illustrates a front elevation, assembled view of the elevated knife plate bracket, wooden post and concrete support of FIG. 11.
Figure 16:
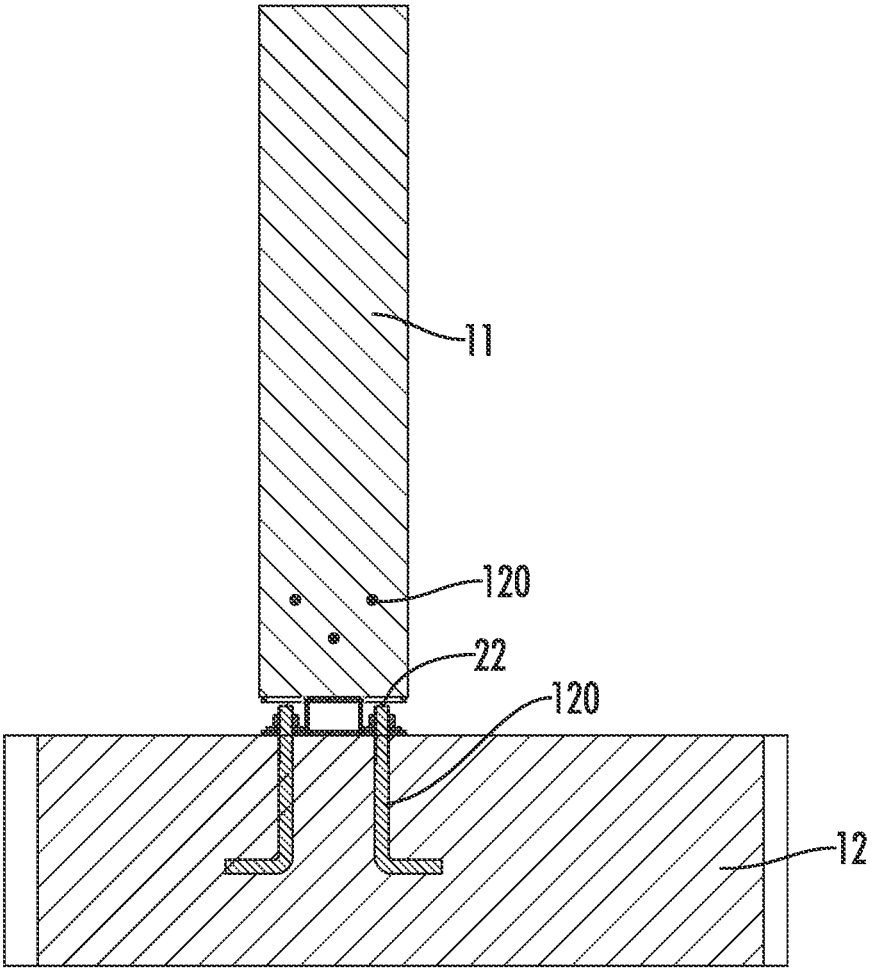
FIG. 16 illustrates a sectional view of the elevated knife plate bracket, wooden post and concrete support of FIG. 15 taken along line 16-16 of FIG. 15.
Figure 17:
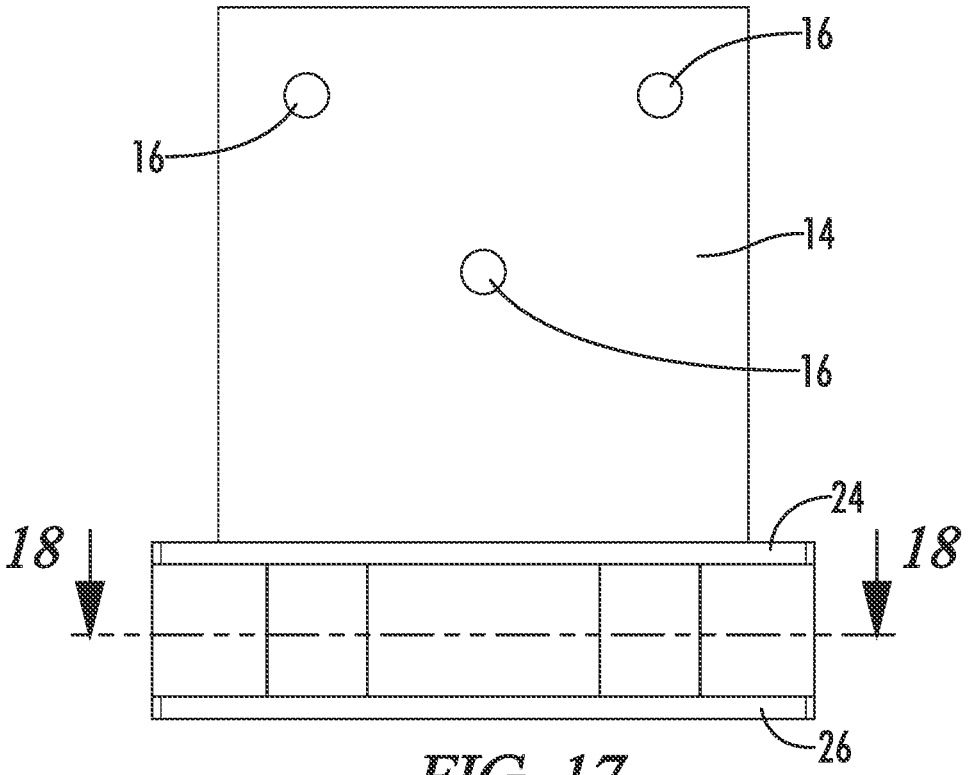
FIG. 17 illustrates a front elevation view of the elevated knife plate bracket of FIG. 1.

Optionally, as seen in FIG. 11 for example, the fastener 120 that secures the lower base plate 26 to the support surface 11 is rebar and is L-shaped.

Figure 9:
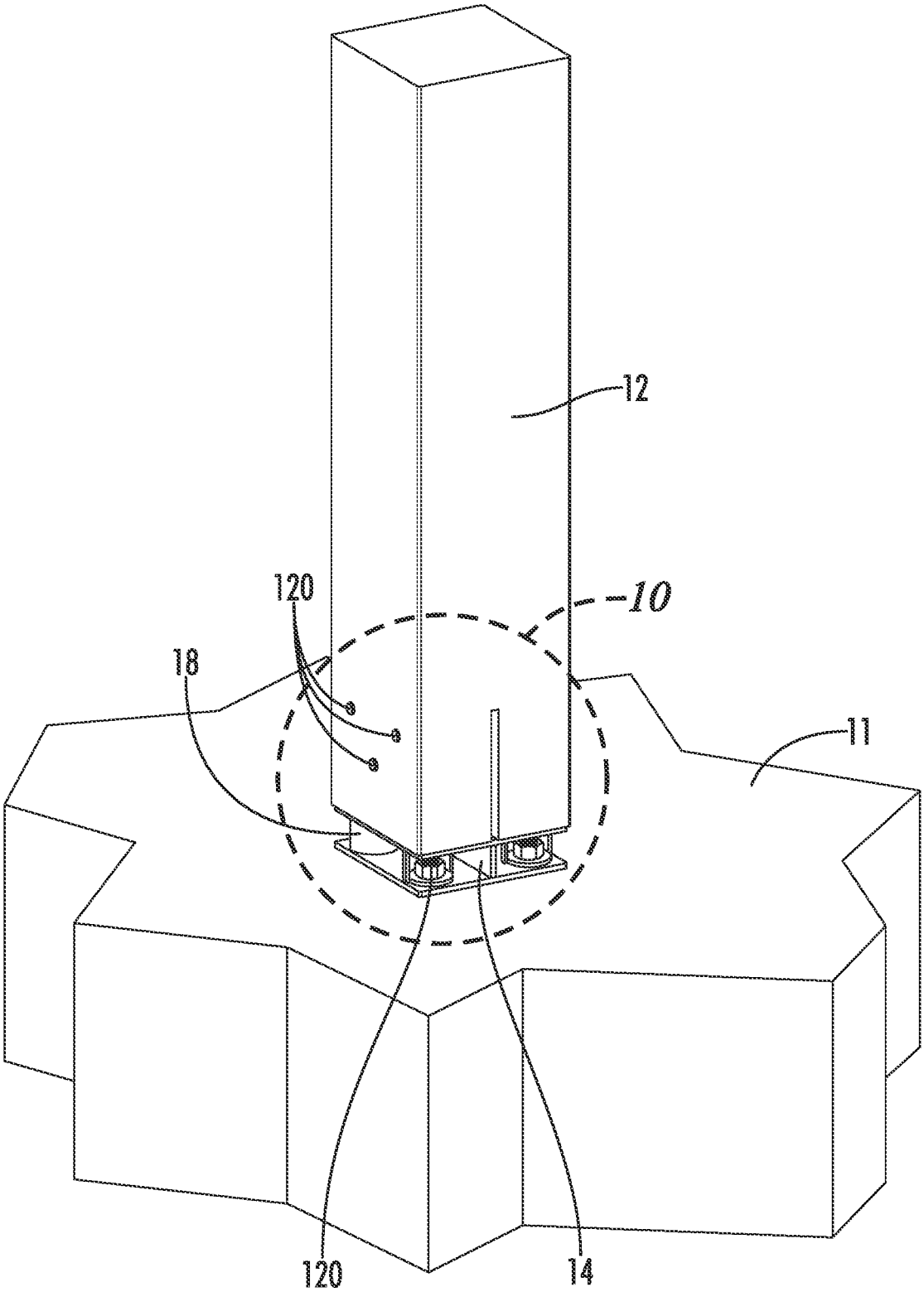
FIG. 9 illustrates a side perspective view of the elevated knife plate bracket of FIG. 1 joining a wooden post and a concrete support surface.
Figure 10:
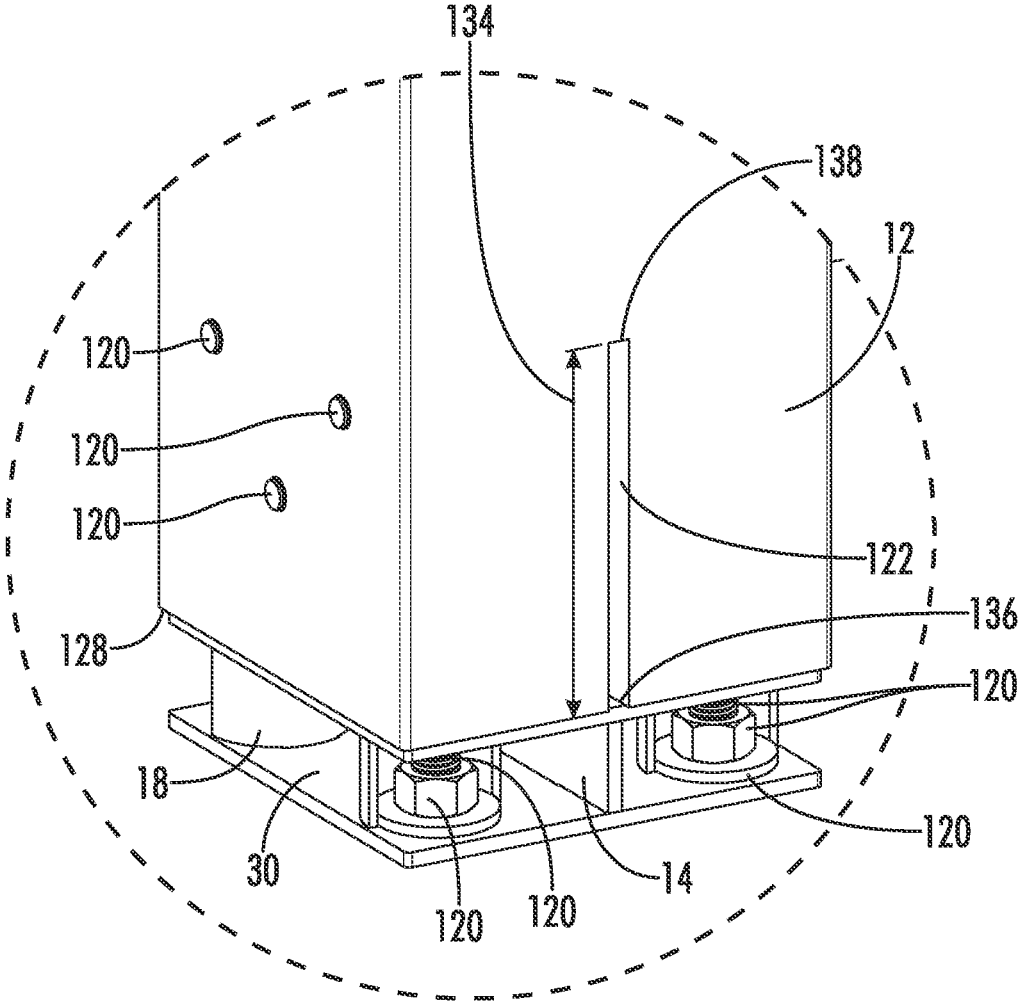
FIG. 10 illustrates a side perspective view of the area of the post, elevated knife plate bracket and concrete support surface located within the circle of FIG. 9.

Optionally, as seen in FIG. 9 for example, the fastener 120 that secures the vertical post 12 to the knife plate 14 is a dowel.

As in the embodiment depicted in FIGS. 1-19, the knife plate fastener hole may comprise three knife plate fastener holes 16 arranged in the pattern of an isosceles triangle.

As shown in FIGS. 1-19, the knife plate fastener hole 16 and fastener 120 may be oriented perpendicularly to the upper and lower base plate heights 50, 36.

As shown in FIGS. 1-19, the knife plate height 82 may be at least five times greater than the lower base plate height 36 and the upper base plate height 50.

As shown in FIGS. 1-19, the upper base plate length 48 and width 46 and the lower base plate length 34 and width 32 may be at least five times greater than the upper base plate height 50 and the lower base plate height 36.

As shown in FIGS. 1-19, the knife plate height 82 is at least five times greater than the knife plate thickness 85.

Optionally, the upper base plate top surface 44 is configured to support a vertical post 12 bearing a load of at least one hundred pounds. In other words, the bracket 10 may be configured to support a load-bearing vertical post 12 that is part of a building or other structure.

As shown in FIGS. 1-19, the vertical post bottom 128 may be configured to rest on the upper base plate top surface 44, with the knife plate top 76 configured to rest inside the vertical post slot 122. The lower base plate bottom surface may be configured to rest upon support surface 11. Lower base plate 26 may be secured to support surface 11 by fasteners 120, and vertical post 12 may be secured to knife plate 14 by fasteners 120. Further, fasteners 120 may secure the bracket 10 to the support surface 11 by extending through fastener holes 22. Optionally, fasteners 120 secure the vertical post 12 to the bracket 10 by extending horizontally through the knife plate fastener holes 16. Fasteners for use with the present invention include, for example, nuts, bolts, screws, washers, and dowels.

The present disclosure also provides a method of securing a vertical post 12 to a support surface 11 that may include: a) providing the bracket 10; b) placing the lower base plate bottom surface 28 on the support surface 11; c) placing a lower base plate fastener 120 through the lower base plate fastener hole 22 and into the support surface 11 to secure the bracket 10 to the support surface 11; d) placing the vertical post bottom 128 on the upper base plate top surface 44 so that the knife plate 14 extends upwardly into the vertical post slot 122; and e) placing a knife plate fastener 120 at least partially through the vertical post thickness 132, and through the knife plate fastener hole 16 to secure the vertical post 12 to the bracket 10.

| PART LIST | |
|---|---|
| Elevated Knife Plate Bracket | 10 |
| Support Surface | 11 |
| Vertical Post | 12 |
| Knife Plate | 14 |
| Knife Plate Fastener Hole | 16 |
| Support Wall | 18 |
| Access Hole | 20 |
| Fastener Hole | 22 |
| Upper Base Plate | 24 |
| Lower Base Plate | 26 |
| Lower Base Plate Bottom Surface | 28 |
| Lower Base Plate Top Surface | 30 |
| Lower Base Plate Width | 32 |
| Lower Base Plate Length | 34 |
| Lower Base Plate Height | 36 |
| Fastener Hole Height | 38 |
| Fastener Hole Width | 40 |
| Fastener Hole Length | 41 |
| Upper Base Plate Bottom Surface | 42 |
| Upper Base Plate Top Surface | 44 |
| Upper Base Plate Width | 46 |
| Upper Base Plate Length | 48 |
| Upper Base Plate Height | 50 |

-continued

| PART LIST | |
|---|---|
| Knife Plate Upper Portion | 52 |
| Knife Plate Laterally Extended Portion | 54 |
| Upper Base Plate Knife Plate Slot | 56 |
| Upper Base Plate Knife Plate Slot Height | 58 |
| Upper Base Plate Knife Plate Slot Width | 60 |
| Upper Base Plate Knife Plate Slot Length | 62 |
| Access Hole Height | 64 |
| Access Hole Width | 66 |
| Access Hole Length | 67 |
| Access Hole Support Wall Slot | 68 |
| Knife Plate Bottom | 70 |
| Knife Plate Bottom Width | 72 |
| Knife Plate Bottom Length | 74 |
| Knife Plate Top | 76 |
| Knife Plate Top Width | 78 |
| Knife Plate Top Length | 80 |
| Knife Plate Height | 82 |
| Knife Plate Front | 84 |
| Knife Plate Thickness | 85 |
| Knife Plate Rear | 86 |
| Knife Plate Left Side | 88 |
| Knife Plate Right Side | 90 |
| Knife Plate Fastener Hole Width | 92 |
| Knife Plate Fastener Hole Height | 94 |
| Support Wall Top | 96 |
| Support Wall Bottom | 98 |
| Support Wall Top Ledge | 100 |
| Support Wall Bottom Ledge | 102 |
| Support Wall Wide Portion | 104 |
| Lower Base Plate Support Wall Slot | 106 |
| Lower Base Plate Knife Plate Slot | 108 |
| Lower Base Plate Knife Plate Slot Height | 110 |
| Lower Base Plate Knife Plate Slot Length | 112 |
| Lower Base Plate Knife Plate Slot Width | 114 |
| Knife Plate Top Ledge | 116 |
| Knife Plate Bottom Ledge | 118 |
| Fasteners | 120 |
| Vertical Post Slot | 122 |
| Vertical Post Fastener Hole | 124 |
| Vertical Post Top | 126 |
| Vertical Post Bottom | 128 |
| Vertical Post Height | 130 |
| Vertical Post Thickness | 132 |
| Vertical Post Slot Height | 134 |
| Vertical Post Slot Bottom | 136 |
| Vertical Post Slot Top | 138 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. It is understood that use of the singular embraces the plural and vice versa. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously.

What is claimed is:

1. A method of securing a vertical post to a support surface, the vertical post comprising a vertical post top, a vertical post bottom, a vertical post height extending from the vertical post top to the vertical post bottom, a vertical post thickness generally perpendicular to the vertical post height, a vertical post slot comprising a vertical post slot bottom located at the vertical post bottom, a vertical post slot top, and a vertical post slot height extending from the vertical post slot top to the vertical post slot bottom generally parallel to the vertical slot height, the method comprising the steps of:

a) providing an elevated knife plate bracket comprising:

i) a lower base plate comprising a lower base plate bottom surface configured to rest on the support surface, a lower base plate top surface located above the lower base plate bottom surface, a lower base plate height extending from the lower base plate bottom surface to the lower base plate top surface, a lower base plate length generally perpendicular to the lower base plate height, a lower base plate width generally perpendicular to the lower base plate height and length, and a lower base plate fastener hole extending through the lower base plate from the lower base plate bottom surface to the lower base plate top surface, the lower base plate fastener hole having a lower base plate fastener hole height generally parallel to the lower base plate height, a lower base plate fastener hole width generally perpendicular to the lower base plate fastener hole height and a lower base plate fastener hole length generally perpendicular to the lower base plate fastener hole height and width;

ii) an upper base plate located above the lower base plate and comprising an upper base plate bottom surface facing the lower base plate top surface, an upper base plate top surface located above the upper base plate bottom surface and configured to receive the bottom of the vertical post, an upper base plate height extending from the upper base plate bottom surface to the upper base plate top surface and generally parallel to the lower base plate height, an upper base plate length generally perpendicular to the upper base plate height, an upper base plate width generally perpendicular to the upper base plate height and length, and an upper base plate access hole extending through the upper base plate from the upper base plate bottom surface to the upper base plate top surface, the upper base plate access hole located directly above the lower base plate fastener hole and having an upper base plate access hole height generally parallel to the upper base plate height, an upper base plate access hole width generally perpendicular to the upper base plate access hole height and an upper base plate access hole length generally perpendicular to the upper base plate access hole height and width;

iii) a knife plate extending upward from the upper top plate surface at an angle of about 90 degrees relative to the upper base plate top surface, the knife plate comprising a knife plate top located above the upper base plate top surface, a knife plate bottom, a knife plate height generally parallel to the upper base plate height, a knife plate front, a knife plate rear, a knife plate thickness extending from the knife plate front to the knife plate rear and generally perpendicular to the knife plate height, and at least one knife plate fastener hole located above the upper base plate top surface, the at least one knife plate fastener hole having a length extending generally perpendicular to the upper base plate height, the knife plate fastener hole extending through the knife plate from the knife plate front to the knife plate rear; and iv) a support wall extending between the lower base plate and the upper base plate and at least partially supporting the upper base plate, wherein the lower base plate fastener hole comprises four circular lower base plate fastener holes, wherein the upper base plate access hole comprises four upper base plate fastener holes, wherein each lower base plate fastener hole is located directly below an upper base plate access hole, wherein the support wall comprises four semi-cylindrical support walls, wherein each of the respective four semi-cylindrical support walls partially surrounds one of the four circular lower base plate fastener hole and one of the upper base plate access holes, and further wherein each of said semi-cylindrical support walls are separated from the knife plate by a space and are not attached to the knife plate;

b) placing the lower base plate bottom surface on the support surface;

c) placing a lower base plate fastener through a lower base plate fastener hole and into the support surface to secure the elevated knife plate bracket to the support surface;

d) placing the vertical post bottom directly on top of the upper base plate top surface so that the knife plate extends upwardly into the vertical post slot; and e) placing a knife plate fastener at least partially through the vertical post thickness, and through the knife plate fastener hole to secure the vertical post to the elevated knife plate bracket.

2. The method of claim 1 wherein the knife plate bottom is located between the upper base plate bottom surface and the lower base plate top surface.

3. The method of claim 1 wherein the upper base plate comprises an upper base plate knife plate slot extending from the upper base plate top surface to the upper base plate bottom surface, the upper base plate knife plate slot having an upper base plate knife plate slot height generally parallel to the upper base plate height, an upper base plate knife plate slot width generally perpendicular to the upper base plate knife plate slot height, and an upper base plate knife plate slot length generally perpendicular to the upper base plate knife plate slot height and width, the upper base plate knife plate slot length larger than the upper base plate knife plate slot height and width and further wherein the knife plate extends from the lower base plate through the upper base plate knife plate slot and at least two inches above the upper base plate top surface.

4. The method of claim 3 wherein the knife plate comprises a knife plate left side, a knife plate right side, a knife plate width extending from the knife plate left side to the knife plate right side and generally perpendicular to the knife plate thickness and the knife plate height, wherein the knife plate comprises a knife plate upper portion located above the upper base plate top surface, a knife plate laterally extended portion located below the upper base plate bottom surface, the knife plate upper portion and the knife plate laterally extended portion each having a width generally parallel to the knife plate width, the knife plate laterally extended portion comprising a top comprising a top ledge located adjacent to the upper base plate knife plate slot, confronting the upper base plate bottom surface and at least partially supporting the upper base plate, the width of the knife plate laterally extended portion greater than the upper base plate knife plate slot length and the knife plate upper portion width.

5. The method of claim 4 wherein the top ledge comprises a left top ledge located to the left of the upper base plate knife plate slot and confronting the upper base plate bottom surface, and a right top ledge located to the right of the upper base plate knife plate slot and confronting the upper base plate bottom surface.

6. The method of claim 4 wherein the lower base plate bottom further comprises a lower base plate knife plate slot receiving the knife plate bottom, the lower base plate knife plate slot having a lower base plate knife plate slot height generally parallel to the lower base plate height, a lower base plate knife plate slot width generally perpendicular to the lower base plate knife plate slot height, a lower base plate knife plate slot length generally perpendicular to the lower base plate knife plate slot height and width, the lower base plate knife plate slot length larger than the lower base plate knife plate slot height and width, wherein the knife plate laterally extended portion comprises a bottom comprising a bottom ledge located adjacent to the lower base plate knife plate slot and confronting the lower base plate top surface, the width of the knife plate laterally extended portion greater than the lower knife base plate knife plate slot length and the knife plate upper portion width.

7. The method of claim 6 wherein the bottom ledge comprises a left bottom ledge located to the left of the lower base plate knife plate slot and confronting the lower base plate top surface, and a right bottom ledge located to the right of the lower base plate knife plate slot and confronting the lower base plate top surface.

8. The method of claim 1 wherein the upper base plate is located directly above the lower base plate.

9. The method of claim 8 wherein the upper base plate width is generally parallel to and substantially equal in size to the lower base plate width and the upper base plate length is generally parallel to and substantially equal in size to the lower base plate length.

10. The method of claim 1 wherein the upper base plate bottom surface is located between about 1 and about 3 inches above the lower base plate top surface.

11. The method of claim 1 wherein the knife plate is located approximately in the center of the upper base plate width and/or upper base plate length.

12. The method of claim 1 wherein step e) comprises placing a knife plate fastener through a first side of the vertical post, through the knife plate fastener hole, and out the second side of the vertical post to secure the vertical post to the elevated knife plate bracket.

13. The method of claim 1 wherein the support surface is comprised of concrete and further wherein the lower base plate fastener is rebar.

14. The method of claim 1 wherein the knife plate fastener is oriented perpendicular to the upper and lower base plate heights.

15. The method of claim 1 wherein the knife plate height is at least five times greater than each of the lower base plate and upper base plate heights.

16. The method of claim 1 wherein each of the lengths and widths of the upper and lower base plates is at least five times greater than the heights of each of the upper and lower base plates.

17. The method of claim 1 wherein the knife plate height is at least five times greater than the knife plate thickness.

18. The method of claim 1 wherein the upper base plate top surface is configured to support a vertical post bearing a load of at least one hundred pounds.

19. The method of claim 1 wherein the lower base plate bottom surface is generally flat, not considering the fastener holes, such that the lower base plate bottom surface is generally flush against the support surface upon which the lower base plate is placed.

20. The method of claim 1 wherein the upper base plate top surface is generally flat, not considering the access holes, such that the upper base plate top surface is generally parallel to the support surface above which the knife plate bracket rests.

21. The method of claim 1 wherein the knife plate fastener is a dowel.

22. The method of claim 1 wherein the knife plate fastener hole comprises three knife plate fastener holes arranged in the pattern of an isosceles triangle.

* * * * *